US007134428B2

(12) United States Patent
Rösel

(10) Patent No.: US 7,134,428 B2
(45) Date of Patent: Nov. 14, 2006

(54) METHOD FOR DAMPING PRESSURE OSCILLATIONS IN A MEASURING SIGNAL OF A LAMBDA PROBE

(75) Inventor: Gerd Rösel, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 183 days.

(21) Appl. No.: 10/510,654

(22) PCT Filed: Apr. 22, 2004

(86) PCT No.: PCT/EP2004/050583

§ 371 (c)(1),
(2), (4) Date: Oct. 8, 2004

(87) PCT Pub. No.: WO2004/109080

PCT Pub. Date: Dec. 16, 2004

(65) Prior Publication Data

US 2006/0157037 A1 Jul. 20, 2006

(30) Foreign Application Priority Data

Jun. 4, 2003 (DE) ..... 103 25 338

(51) Int. Cl.
*F02D 41/14* (2006.01)
*F01N 3/00* (2006.01)

(52) U.S. Cl. ..... 123/687; 701/109; 73/118.1

(58) Field of Classification Search ..... 123/687; 60/276, 285; 701/103–105, 109; 73/117.3, 73/118.1

See application file for complete search history.

(56) References Cited

U.S. PATENT DOCUMENTS

| | | | | |
|---|---|---|---|---|
| 6,105,366 | A * | 8/2000 | Zhang | 60/274 |
| 6,799,419 | B1 * | 10/2004 | Rosel et al. | 60/277 |
| 2003/0084659 | A1 | 5/2003 | Bruck et al. | |

FOREIGN PATENT DOCUMENTS

| | | | |
|---|---|---|---|
| DE | 37 43 315 | | 6/1989 |
| DE | 103 39 414 | A1 | 7/2004 |
| EP | 0 899 441 | | 3/1999 |
| JP | 202-188981 | * | 7/2002 |
| WO | WO 2004/063939 | A2 | 7/2004 |

* cited by examiner

*Primary Examiner*—Hai Huynh
(74) *Attorney, Agent, or Firm*—Morrison & Foerster LLP

(57) ABSTRACT

In order to average the continuously sampled individual values of the measuring signal through totaling over a summation period (TP1, TP2), said period corresponding to the period, dependent on engine speed, of pressure pulsations of the exhaust, while at the same time sparing the memory resources, it is proposed for totaling to be carried out across the N1 individual values block-by-block and already to start before signal updating so that the block values already formed continuously block-by-block up to the update time ($t_n$) and buffered instead of the respective individual values are used for calculating an average.

8 Claims, 3 Drawing Sheets

METHOD FOR DAMPING PRESSURE OSCILLATIONS IN A MEASURING SIGNAL OF A LAMBDA PROBE

TECHNICAL FIELD OF THE INVENTION

The invention relates to a method for damping pressure oscillations in a measuring signal of a lambda probe, and in particular, to obtaining a correctively adjusted output signal from the measuring signal, having a periodic pressure dependence, of a lambda probe located in the exhaust of an internal combustion engine.

BACKGROUND OF THE INVENTION

DE 37 43 315 A1 discloses oxygen sensors mounted in an exhaust pipe used to continuously determine the air/fuel ratio with a high response rate in both the "lean"—lambda greater than one—and the "rich"—lambda less than one—mixture range. These, what are termed continuous or linear lambda probes, operate according to the two-cell limit-current probe principle and can be used as pre-cat probes for injection controlling (lambda controlling), but especially for controlling lean-burn engines, for example Otto engines having direct fuel injection.

The measuring signal of a lambda probe depends on a plurality of variables, including the oxygen concentration to be determined in the exhaust and the temperature of the ceramic and the counter-pressure of the exhaust, with the degree of pressure dependence of the measuring signal being defined by the design of the probe. A distinction is made where the pressure dependence is concerned between a static and a dynamic pressure dependence. Typical variations in the dynamic pressure dependence of the measuring signal are within the significant range in the case of continuous lambda probes and hence are an order of magnitude higher than for what are termed binary lambda probes. The following concerns the damping or, as the case may be, elimination of periodic pressure-related influencing factors, especially in connection with continuous lambda probes.

Pressure pulsations in the exhaust system are due partly to the abrupt rise in the positive pressure curve triggered by a pressure surge produced when discharge valves of a cylinder are opened. A waveform pressure curve is produced by reflections or overlapping exhaust oscillation in the exhaust system until another pressure surge occurs upon the cylinder's next ejection stroke. An internal combustion engine operated by the four-stroke method therefore produces a dynamic exhaust-pressure curve having a periodicity of 720° KW referred to the crankshaft, which is to say dependent on engine speed. The possibility of hardware-based filtering is limited, because the frequency of the pressure-dependent interference within the lambda signal depends on the internal combustion engine's speed, and the central control device of the internal combustion engine must remain suitable for measuring rapid processes (lambda controlling on a cylinder-selective basis, for instance). Based on the above-described characteristic periodicity of the processes, signal filtering requires averaging over a specific crank-angle range of the internal combustion engine, for example, in the case of a four-cylinder four-stroke internal combustion engine having a single-flow exhaust system, 720° KW/4=180° KW.

The generic method accordingly proposes an integration period or summation period corresponding to the engine speed dependent period of oscillation of the pressure curve, which is 180° KW in the example above. Above-cited DE 37 43 315 A1 mentions the possibility of providing separate summation equipment to relieve the vehicle's microcomputer of the special function of signal filtering. The following problems are involved:

The known method for averaging obviously requires a relatively large amount of memory to be reserved for the individual measurements of the lambda probe signal which are sampled in, for example, a 1-ms time-slot pattern and buffered in a ring memory. For further processing of the lambda probe signal, averaging would then be initiated at each instant at which a filtered output signal is required (e.g., every 10 ms) by totaling a number N1 of buffered individual values and dividing the result by N1. For the given sampling time-slot pattern the number N1 would exactly correspond to the period of oscillation of the pressure curve. With this procedure, for a four-cylinder internal combustion engine, 50 individual values would have to be stored simultaneously in the memory for, e.g., 600 revolutions; for a 6-cylinder two-bank system a total of 67*2=134 individual values would have to be stored. Averaging would furthermore always, which is to say at each update time, have to be carried out across the entire number of N1 measurements for the period to be considered so that, especially in the case of slow engine speeds, the summation value would be formed several times over certain sections of the memory.

SUMMARY OF THE INVENTION

The invention relates to a method for obtaining a correctively adjusted output signal from the measuring signal, having a periodic pressure dependence, of a lambda probe located in the exhaust of an internal combustion engine, whereby said measuring signal is sampled in a time-slot pattern and averaged through totaling over a specified summation period, the period corresponding to the period of oscillation, dependent on engine speed, of pressure pulsations of the exhaust.

According to an embodiment of the invention, the method for signal evaluation is for continuously-sampled individual values of the measuring signal to be buffered in a memory area of a memory of a control device for the internal combustion engine and for averaging that includes a number N1, corresponding to the summation period, of individual values sampled in the time-slot pattern to be initiated by the control device at each instant at which an updated probe output signal is required. These steps are performed in such a way that totaling is carried out across the N1 individual values block-by-block and starts before the update time so that the block values already formed continuously block-by-block up to the update time and buffered, instead of the respective individual values, are used for calculating an average.

The signal conditioning method according to the invention is therefore geared in particular to a favorable block algorithm according to the formula $$VLS = \frac{1}{N1}\left[\sum_{i=1}^{M1} \text{VLS_1ms} + \sum_{i=M1+1}^{2*M1} \text{VLS_1ms} + \cdots + \sum_{i=N*M1+1}^{N1} \text{VLS_1ms}\right]$$

which facilitates advantageous memory configuring or, as the case may be, memory organization. In the above formula, VLS signifies the average, currently requiring to be calculated, of the lambda probe voltage signal, VLS_1ms signifies a single non-linearized value of the lambda signal sampled in, for instance, a 1-ms time-slot pattern, N1 signifies the number, dependent on engine speed, of individual values employed according to the period of oscillation for averaging, N signifies a whole number, and M1 signifies the block length, which is to say the number of individual values contained in a block.

The summation values already continuously formed block-by-block over M1 measuring signals and the remainder of the N1−(N*M1) measurements are accordingly used for calculating an average VLS. The storage requirements can thereby be reduced to such an extent that only (N+M1) block values or individual values have to be buffered. There is also a reduction in computing requirements. The maximum possible engine speed and the updating rate of the averaged measurement must be taken into consideration in determining the number M1. The relationships improved according to the invention can be made clear using, for example, the recording of measurements over an extended period of time, in this case 1 s, with updating being performed in a 10-ms time-slot pattern and with averaging over N1=30 measurements (M1=10):

Previously: 100*30 summations+100 divisions

Invention: 100*10 summat.+100*3 summat.+100 divisions

Prev. storage requirements: 50 values (at slow engine speeds it is possible for N1>30)

Storage requirements, invention: 10 (indiv.) values+4 values

In one embodiment, the invention is directed to segment-synchronous averaging. This means that, for totaling purposes, it should be possible, at any update time, to "look back" immediately and precisely over the N1 last sampled individual values forming the segment currently being averaged of the continuously-sampled individual values.

So that this can be realized in the context of block-by-block totaling, according to the invention, it is advantageous to perform the following partial synchronizing:

Block-by-block totaling is carried out over M1 sequentially-sampled and buffered individual values (M1 block) and is performed in a block time-slot pattern corresponding to M1 times the sampling time-slot pattern (sampling rate), as a result of which the updating rate can be synchronized with the M1 block time-slot pattern. In the event that the segment length is an integer multiple of the block length, which is to say if N1=N*M1, segment-synchronous averaging can then be realized simply by using the N-buffered block values for calculating. It is, however, also possible to total the N−1 block values and all M1 individual values in the "last" M1 block ending at the update time.

In the case of a segment length N1 differing from the multiple of the block length, for averaging that is as segment-synchronous as possible, it is necessary in a second step to perform further partial steps amounting to taking into consideration either at the end or at the beginning of the summation period only the required part of the relevant M1 block and not all individual values, at least not for current averaging, in order to exactly include N1 individual values in averaging despite the incommensurability prevailing in such cases between block length M1 and segment length N1.

According to one embodiment, it is advantageous in these cases, where the number N1 does not correspond to a multiple N of M1, to include the first N1−N*M1 individual values in the last sampled M1 block that extend beyond a maximum multiple N*M1 individually in a current averaging, with the remaining individual values in the M1 block being left out of consideration here and included in the averaging following the current averaging in the form of a block value to be formed for this entire M1 block and buffered. In this embodiment, a defined number (1 to 9, for example, in the case of an M1=10 block) of individual values occurring immediately before the update time that are not to be processed in the current summation period will accordingly initially be left out of consideration. A "dead time," amounting, in the example given, to 1 to 9 times the individual value sampling interval (sampling rate), should be accepted in this embodiment in terms of the average's actual currency at the update time.

In a second embodiment, certain remaining, currently not required, individual values temporally preceding the current summation period in an earliest M1 block to be used for the current averaging are left out of consideration. Specifically, in cases where the number N1 does not correspond to a multiple N of M1, each M1 block is split into two partial blocks B1 and B2, with the partial block B2 including the last N1−N*M1 individual values in the respective M1 block that extend beyond a maximum multiple N*M1 and with the partial block B1 including the remaining first M1−(N1−N*M1) individual values in the M1 block. The two respective partial blocks B1 and B2 are furthermore totaled block-by-block in a block time-slot pattern into partial block values MW_B1 and MW_B2, which are buffered in place of the respective individual values. Finally, the two partial block values in the N last processed M1 blocks and the partial block value MW_B2 of the M1 block processed immediately before the N last M1 blocks are then used for current averaging. A dead time is thereby avoided and averaging actually takes place over the N1 individual values immediately preceding the update time.

The advantages of a reduction in memory space requirements facilitated by the invention can be realized in particular by operating the memory area in the ring memory mode.

The method is particularly suitable in conjunction with evaluating the measuring signal of a lambda probe which has a continuous characteristic curve of the measuring signal and which is located upstream of a catalytic converter of the internal combustion engine.

BRIEF DESCRIPTION OF THE DRAWINGS

The invention is explained in more detail below with reference to exemplary embodiments and the figures in the drawings, in which.

DETAILED DESCRIPTION OF THE INVENTION

Figure 1:
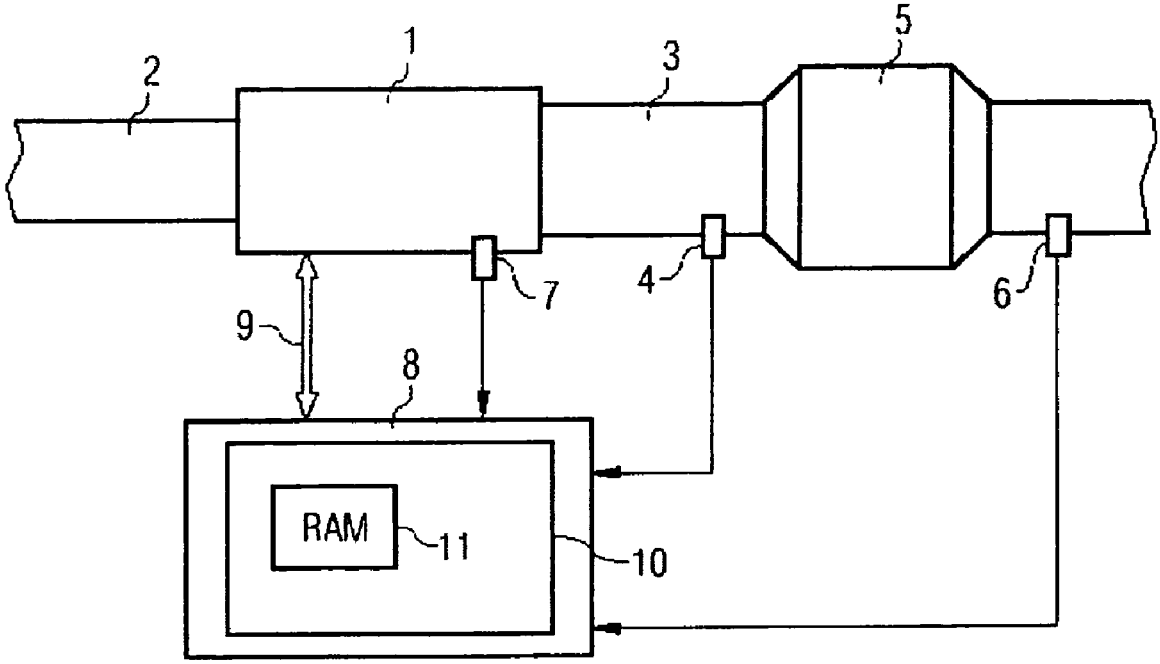
FIG. 1 shows an internal combustion engine having a lambda probe whose signal is to be conditioned.

FIG. 1 shows, in block diagram form, an application of the invention. The only components shown are those necessary for understanding the invention. An air/fuel mixture is routed to the internal combustion engine 1 through an intake channel 2. An air-mass meter (not shown), can also be located in the intake channel 2. The internal combustion engine 1 is connected on the output side to an exhaust channel 3. Provided in the exhaust channel 3 is a first lambda probe 4, a three-way catalytic converter 5 serving to convert harmful exhaust constituents, and a second lambda probe 6. The fuel/air ratio in the exhaust ahead of the catalytic converter 5 is determined with the aid of the first lambda probe 4 (control probe) having a continuous characteristic curve. The second lambda probe 6 (monitor probe) serves, inter alia, to check the catalytic converter 5 and typically has a binary characteristic curve. Located at a suitable position on the internal combustion engine 1 is a speed sensor 7 which serves to register the speed of the internal combustion engine 1 and whose signal is routed to a central control device 8 over an associated connecting lead.

To control and regulate the internal combustion engine 1 the control device 8 can be connected via a data and control lead 9, shown only schematically, to additional sensors and actuators. The control device 8 which, inter alia, controls the injection process has a microcomputer 10, corresponding interfaces for signal conditioning circuits, and an in-put/output unit. The microcomputer 10 includes a central processing unit (CPU) that performs the arithmetic and logical operations applying the supplied data. The programs and reference data required for this are supplied by a read-only memory (ROM). A random access memory (RAM) 11 serves, inter alia, to store the data supplied by the sensors until it is called up by the microcomputer 10 or replaced, which is to say overwritten, by more current data. The method according to the invention serves essentially to spare the resources of the memory 11, which are burdened by the necessary buffering in an area of the memory 11 of values which are associated with the corrective adjustment of the pressure dependence of the measuring signal of the lambda probe 4.

Figure 2:
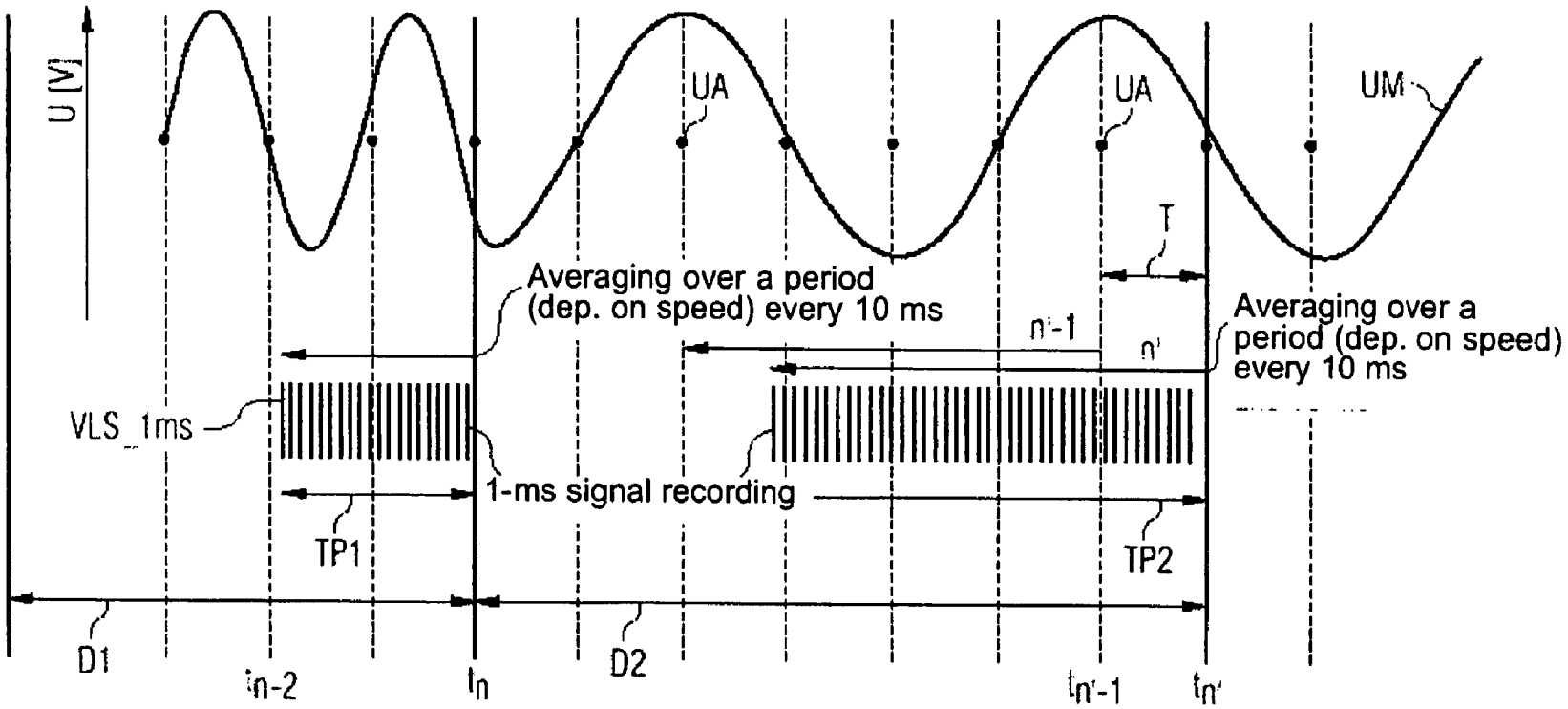
FIG. 2 is a chart showing different speeds of the internal combustion engine and time dependence of the signal being conditioned.

The top part of FIG. 2 shows a periodically time-dependent voltage signal UM representing the unfiltered measuring signal of the lambda probe 4. The thin vertical lines indicate the pattern of the updating rate T of the output signal, with averaging over a period of oscillation TP, dependent on engine speed, of pressure pulsations of the exhaust taking place every 10 ms in the example shown (four-cylinder engine having a single-flow exhaust system). The updating rate T=10 ms is synchronized with the M1 block time-slot pattern, which is in turn based on the 1-ms time-slot pattern selected here for sampling individual values. Each M1 block therefore includes 10 individual values in the example given. The filtered output signal, calculated in each case at the update times $t_n$ or, as the case may be, $t_n'$, is represented by the voltage values UA indicated by dots in FIG. 2. As can be expected for a properly controlled operating state, the averaged lambda output signal therefore exhibits a constancy across the different engine-speed ranges D1 or, as the case may be, D2, marked by the thick vertical lines, of the internal combustion engine 1.

As averaging has to take place precisely over one period of oscillation TP of the pressure pulsations, a length of summation dependent on engine speed, which is to say TP1 for D1 and TP2 for D2, is first determined by the control device 8. A defined number of single non-linearized values of the measuring signal corresponds to this summation period, depending on the selected sampling rate of the measuring signal, in this case 1 ms. In the example shown in FIG. 2, the left-hand part of the figure shows a range D1 having an increased engine speed (1,666 revolutions/min, for instance) where a summation period of 18 ms is calculated so that, for averaging, it is necessary in each case to total, across a segment totaling N1=18, individual values VLS_1ms. At each update time $t_n$, in this case, for instance, at the end, marked by the left-hand thick line, of the engine-speed range D1, it is necessary in each case to total across precisely 18 of the past individual values, as indicated in FIG. 2 by means of the 18 short lines and the arrow above them symbolizing the retrospective view adopted for averaging. On the other hand, there is a relatively longer summation period for the area between the two thick vertical lines in FIG. 2 owing to the range D2 represented there having a slower engine speed and, in keeping with this, there is a correspondingly greater number N1 of individual values to be totaled, in the example shown here (D2=714 revolutions) N1=41. The segments n' or n'−1 to be observed at the update time $t_n$, and, immediately preceding this, $t_{n'-1}$, are indicated in the engine-speed range D2 in FIG. 2, again using arrows.

According to an embodiment of the invention, the 18 individual values VLS_1ms in the faster engine-speed range D1 shown, which are to be totaled, are not all stored in the buffer until summation. Rather, the first 10 temporarily first sampled individual values in a segment are written successively to the buffer, where applicable, with the individual values in a (M1=10) block created during immediately preceding averaging being overwritten, and are then processed block-by-block, i.e., they are totaled into a block value at the end of the relevant (M1=10) block time interval. This individual block value representing the filtered information, assembled from 10 individual values, about the average of the measuring signal in the time interval of the given block, is retained in the buffer until the next updating, while the 10 buffered "old" individual values are successively overwritten in the ring memory mode by the 10 individual values in the next (M1=10) block.

According to a first embodiment of the invention, in the example shown in FIG. 2, it is possible (in the D1 range) to proceed in such a way that the first (in this case single, since N1=18=1*10+8, so N=1) block value is buffered, and that in the next block time section the 8 individual values still missing from the segment of the N1=18 individual values to be used in total for averaging are initially written one after the other to the positions previously occupied by the old individual values. It is also possible that, in keeping with the time-slot pattern, two further individual values are sampled and written, and that due updating of the average is carried out on completion of said "last" block time section in such a way that the individual block value and the individual first 8 individual values in the last created (M1=10) block are totaled. In parallel with this, 10 individual values in the last created (M1=10) block are totaled into a block value, used during the next updating, and buffered. In the example given, the "current" average determined at a specific update time $t_n$ is therefore, strictly speaking, already 2 sampling intervals "old", intervals which according to the specified synchronizing have to be waited out.

Figure 3:
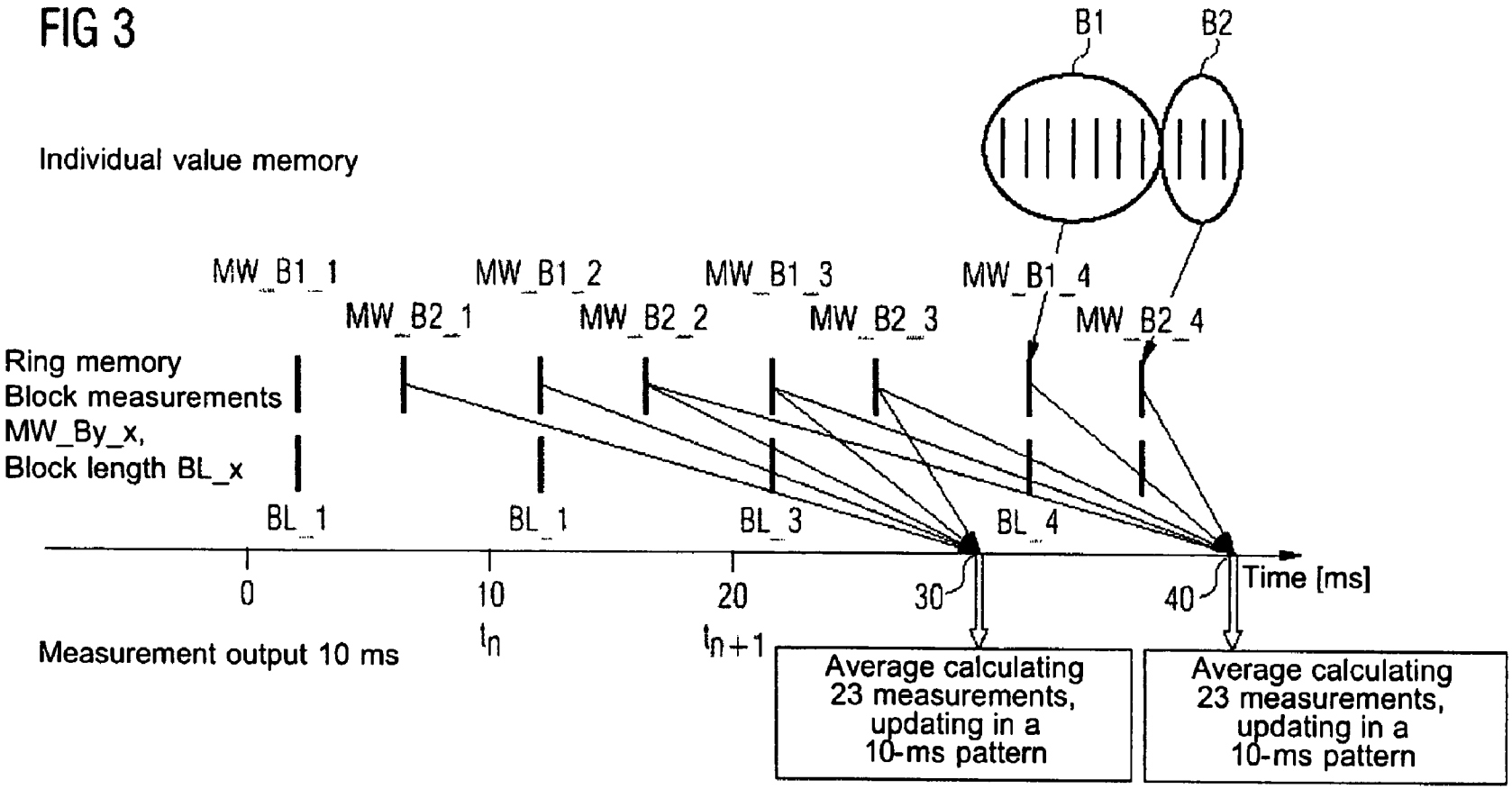
FIG. 3 is an organization chart of steps shown symbolically in three levels for processing individual lambda signal values according to an embodiment of the invention.

FIG. 3 illustrates a second embodiment of the invention that can be used in cases N1≠N*M1 as an alternative to the method discussed in connection with FIG. 2. A single-flow exhaust system of a four-cylinder engine running at 1,304 revolutions per minute, updating in a 10-ms cycle, a sampling time-slot pattern of 1 ms, a block length M1 of 10 individual values, and a summation period of 23 ms, which is to say a segment length N1=23, are assumed in the following explanations by way of example.

The top level ("single-value memory") of FIG. 3 relates to the sampling or buffering of the 10 individual values in a block to be processed. The last four blocks considered are illustrated in FIG. 3 by way of example, with the last block, as indicated symbolically, having been divided, as were the three blocks processed before it, into a first partial block B1 including 7 individual values and a second partial block B2 including 3 individual values. Specific dividing in this way is due, in the example being considered, to the fact that, in accordance with N1=23=2*10+3, a partial block B2 having 3 individual values is required for further calculation.

The middle level in FIG. 3 shows four pairs of partial block values MW_B1 and MW_B2 (the end digit added in the figure relates to origination from one of the four individual value blocks; the lines symbolizing the block values are not to be referred directly to the time axis of the lower level), which were generated one after the other from the corresponding individual value block among the four M1=10 individual value blocks and buffered. For example, the first 7 individual values in the first block were totaled into the partial block value MW_B1__1 and buffered when 10 individual values in this block had been sampled and buffered, while the last 3 individual values in this block were totaled into the partial block value MW_B2__1 and buffered. The no-longer-required associated individual values can then be overwritten by the new individual values in the next, second block. The new individual values are then processed into partial block values MW_B1__2 and MW_B2__2 in a manner analogous to the process for the first block.

The partial block values buffered according to the middle level are required for calculating the average, the results of which calculation are represented symbolically by the lower level ("measurement output") in FIG. 3. As indicated schematically for two update times by lines between the middle and lower level, the current average due after, for instance, 30 ms is calculated by totaling the two partial block values arising from the third block immediately preceding the update time, the two partial block values arising from the second partial block, and the partial block value MW_B2__1 arising from the first block (dividing the result by N1). It is thereby possible, at the respective update time, to look back at the required exact number N1, in this case N1=23, of individual values immediately preceding the update time.

In a preferred embodiment of the invention, in at least one of the processed M1 blocks, one of the two partial block lengths is also buffered until current averaging.

The use of resources and computing time required by the calculations involved in signal conditioning can, as described, be significantly reduced through block-by-block preprocessing of the individual values of the measuring signal of the lambda probe, the main impact of this being a savings in memory resources. A factor to be taken into account is that calculating in a 1-ms time-slot pattern and providing, for example, about 140 memory locations for a two-bank system places heavy demands on the overall resources of an engine control. The advantage according to the invention is therefore advantageous for multi-bank systems.

The invention claimed is:

1. A method for obtaining a correctively adjusted output signal from a measuring signal of a lambda probe located in an exhaust of an internal combustion engine, whereby said measuring signal is sampled in a time-slot pattern and averaged through totaling over a specified summation period, said period corresponding to the period of oscillation, dependent on engine speed, of pressure pulsations of the exhaust, wherein, the continuously-sampled individual values of the measuring signal are buffered in a memory area of a memory of a control device for the internal combustion engine, and the averaging includes a number N1, corresponding to the summation period, of individual values sampled in the time-slot pattern and is initiated by the control device at each instant at which an updated probe output signal is required, wherein totaling is carried out across the N1 individual values block-by-block and begins before an update time, so that the block values already formed continuously block-by-block up to the update time and buffered are used for calculating an average.

2. The method according to claim 1, wherein block-by-block totaling is carried out over M1 sequentially sampled and buffered individual values and is performed in a block time-slot pattern corresponding to M1 times the sampling time-slot pattern, and the update times are synchronized with the M1 block time-slot pattern.

3. The method according to claim 2, wherein in cases where a number N1 does not correspond to a multiple N of M1, a first N1−N*M1 individual values in a last sampled M1 block that extend beyond a maximum multiple N*M1 are included individually in a current averaging, while the remaining individual values in said M1 block are only included in an averaging following a current averaging in the form of a block value to be formed for the entire M1 block and buffered.

4. The method according to claim 2 wherein, when the number N1 does not correspond to a multiple N of M1, each M1 block is split into two partial blocks B1 and B2, the partial block B2 containing the last N1−N*M1 individual values in a respective M1 block that extend beyond a maximum multiple N*M1 and the partial block B1 contains containing the remaining first M1−(N1−N*M1) individual values in the M1 block, the partial blocks B1 and B2 are totaled block-by-block in a block timeslot pattern into partial block values MW_B1 and MW_B2, which are buffered in place of the respective individual values, and the two partial block values in the N last processed M1 blocks and the partial block value MW_B2 of the M1 block processed immediately before the N last M1 blocks are used for current averaging.

5. The method according to claim 4 wherein, one of the two partial block lengths in a processed M1 block is also buffered until current averaging.

6. The method according to claim 1 wherein the memory area is operated in a ring memory mode.

7. The method according to claim 1 wherein the measuring signal of a lambda probe having a continuous characteristic curve of said measuring signal and located upstream of a catalytic converter of the internal combustion engine is evaluated.

8. The method of claim 1, wherein the measuring signal has a periodic pressure dependence.

* * * * *